United States Patent [19]

Tielrooy

[11] Patent Number: 4,936,208

[45] Date of Patent: Jun. 26, 1990

[54] APPARATUS FOR PRINTING OBJECTS SUCH AS CUPS MADE FROM SYNTHETIC MATERIALS

[75] Inventor: Robert W. Tielrooy, Amstelveen, Netherlands

[73] Assignee: Van Dam Machine B.V., Amsterdam, Netherlands

[21] Appl. No.: 342,404

[22] Filed: Apr. 21, 1989

[30] Foreign Application Priority Data

Apr. 25, 1988 [NL] Netherlands ..... 8801067

[51] Int. Cl.[5] ..... B41F 17/22

[52] U.S. Cl. ..... 101/40; 101/350; 101/363

[58] Field of Search ..... 101/40, 364, 363, 351, 101/350, 216

[56] References Cited

U.S. PATENT DOCUMENTS 1,164,212 12/1915 Reifsnyder et al. ..... 101/216

3,223,028 12/1965 Brigham ..... 101/351 X 3,304,863 2/1967 Jurny ..... 101/351

3,859,919 1/1975 Skrypek et al. ..... 101/40 X 4,337,719 7/1982 Vander Griendt et al. ..... 101/40 X

*Primary Examiner*—Clifford D. Crowder

*Attorney, Agent, or Firm*—Foley & Lardner, Schwartz, Jeffery, Schwaab, Mack, Blumenthal & Evans

[57] ABSTRACT

A device for printing objects, such as cups from synthetic material. The objects are received so that they can be contacted by a printing roller, which cooperates with a plurality of printing plates. The printing plates are mounted on printing cylinders and may be supplied with colored ink by a plurality of inking units. The inking units include an ink-duct roller, which is engaged by an ink-duct, as well as a number of further rollers. The ink-duct is slidably supported and biased toward the ink-duct roller and includes a bottom extending to the ink-duct roller and side walls having two rolls which engage the ink-duct roller.

9 Claims, 4 Drawing Sheets

APPARATUS FOR PRINTING OBJECTS SUCH AS CUPS MADE FROM SYNTHETIC MATERIALS

The invention relates to a device for printing objects such as cups from synthetic material and such like, said device comprising a rotating assembly with a number of mandrels on it, on which the cups are shifted which have to be printed and which are supplied by a supply apparatus, so that after this they can be contacted by a printing roller, said printing roller cooperating with a number of printing plates each being mounted on a printing cylinder, to which printing plates ink with various colours can be supplied by means of a number of inking units, each being mounted in its own pivotable support and comprising an ink-duct roller with an ink-duct engaging it, an ink knife, a ductor roller, idler rollers, forme rollers, distributor rollers and such like.

Now the object of the invention is to improve a such like device in such a way that the possibility of leaking of ink is diminished and so the efficiency of the used ink is increased while simultaneously obtaining a printed object meeting high requirements.

Further the object of the invention is to provide a device which is easier to operate and to maintain and which as well is less accessible for disturbances. According to the invention to this end primary it is provided that the ink-duct is slidably supported and is biased towards the ink-duct roller, said ink-duct comprising a bottom extending obliquely downwards to the ink-duct roller and side walls joining this bottom sidelong, the outer side of each of these side walls being provided with two rolls engaging the ink-duct roller and each being rotatably supported by a surface which is excentric in respect of the axis of a pin on which it is mounted, which excentric surface can be adjusted and fixed in respect of said side wall.

So the side walls of the ink duct directly join the operating surface of the ink-duct roller while the distance between said side walls and the ink-duct roller can be exactly adjusted by means of the surfaces lying excentric in respect of the axis of the pins., on which surfaces said rollers are mounted connected to the side walls. By this also the friction between the ink-duct and the ink-duct roller and by this the heat development is made as less as possible.

In case of this it can be provided that the portion of the bottom of the ink duct joining the ink-duct roller is in the shape of a thin plate the end rim of which can be adjusted at the right distance from the ink-duct roller by means of a number of set screws distributed along the length of the plate.

By this again the friction between the thin plate and the ink-duct roller will be at a minimum so that at that place hardly heat development will occur.

According to a preferred embodiment the biasing of the ink duct can take place by means of pins which each by a spring are biased against the ink duct, each pin being movable received in one end of an arm the other end of which is pivotally connected to the ink-duct support so that the pivoting axis of the arm extends parallel to the axis of the pin.

In this way the pin can easily be pivoted away of the ink duct so that also the ink duct can easily be removed from the support.

For obtaining a reliable driving of the distributor roller —or rollers—this is axially movable by means of a crank mechanism being coupled with the drive of the other driven rollers.

To assure an optimum use of the ink in that case it can be provided that the distributor roller at both ends is provided with a radially directed recess in which a spring biased pin can be received for biasing the distributor roller towards the roller cooperating with said distributor roller.

To obtain an optimum printing it can be further provided that the various rollers are supported by spring biased bearings. In this way self-adjustable rollers are obtained by which an optimum engagement and an optimum ink transfer can be obtained between the various rollers.

To obtain a quick and reliable switching in and an easily switching off of an inking unit it can be provided, that the pivotable inking unit support is executed such that when moving the inking unit towards the active position a gear wheel mounted to it is engaging a gear wheel which is driven from a common motor and is supported by the frame of the device, in which position the inking unit can be fastened by means of a roll rotatably around a shaft running perpendicular to the hinge pin and being provided with a curve being open at one end lying in a radial plane for receiving a pin connected to the frame of the device.

By rotating said roll by means of a handle in this way a good fixing of the support of the inking unit in respect of the frame of the device can be obtained.

In particular in that case it can be provided that the roll can be locked in two positions by an element which resiliently snaps into a cavity of the roll.

By this it is obtained that when the inking unit support is pivoted out of its active position the roll will come into a position in which the inking unit is pivoted only over a small angle, said angle, however, being sufficiently large to disengage the gear wheel connected to the support and the driven gear wheel. So in this way the inking unit is switched off without occupying too much space. Only when the inking unit has to be cleaned the roll can be moved towards the position in which the pin connected to the.. frame of the device can leave the curve of the roll.

To make the maintenance of the device easier further it can be provided that the object supply means and the discharge means with their supports are slidable over a given distance in a direction mainly transverse to the center line of the printing roller. So in this way a good accessibility of the various parts of the device is obtained.

Now the invention is described by means of an embodiment shown in the drawing, in which:

FIG. 1 schematically shows a side view of a device according to the invention;

FIG. 2 schematically shows a cross section with in detail a view of an inking unit applied in the device according to FIG. 1;

Figure 1:
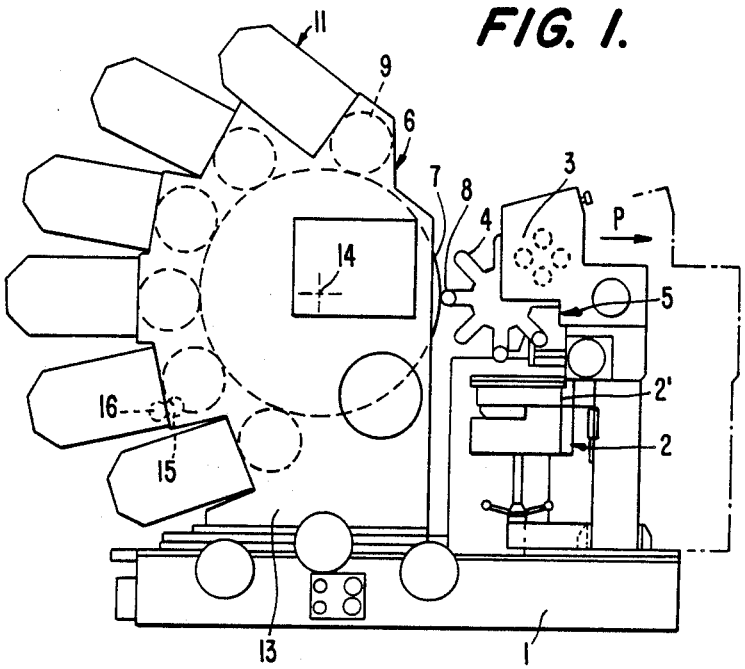

As appears from FIG. 1 the device comprises a base 1 for supporting at least a portion of the supply device 2, a rotating assembly 3 with on it a number of mandrels 4 onto which the supplied object can be brought by means of a transfer device 5, and an object discharge device 2'.

The assembly of supply device, discharge device etc. can be moved in the direction of the arrow P from the active position shown with drawn lines in FIG. 1 towards the position indicated by means of the dashed lines so that various parts of the device are easier accessible. For moving and fastening various hand wheels and such like are present which are not further described.

On the base 1 further the printing device 6 is positioned comprising a printing roller 7 which is engaging an object 8 to be printed and which is present on one of the mandrels 4 of the rotating assembly 3.

Figure 2:
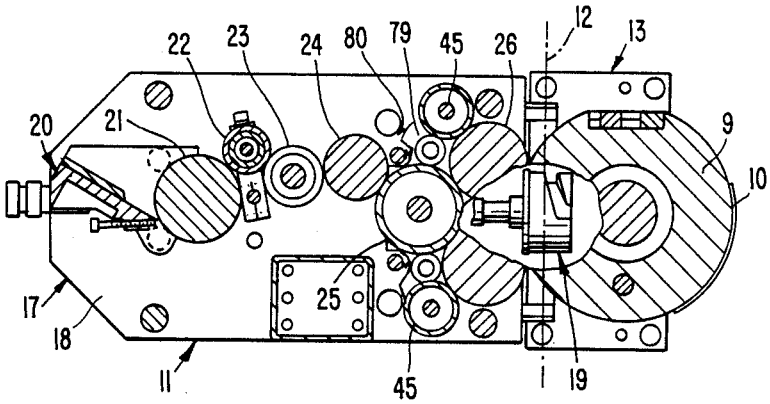

In its turn the printing roller 7 is engaging a number of printing cylinders 9, in this case six, see also FIG. 2, on each of which a printing plate 10 can be mounted.

The ink supply to a printing plate 10 takes place by means of an inking unit 11 so that again six inking units are present each suitable for a given colour.

FIG. 2 schematically shows a cross section of such like inking unit 11. This inking unit 11 is pivotally connected to the frame 13 of the device by means of the hinge pin 12, said frame also supporting the shaft 14 of the printing roller 7, see FIG. 1. The frame 13 also supports a not further indicated motor for driving the printing roller 7, the printing cylinders 9 and the driven shafts of the inking unit 11 such that the circumferential velocities of the various parts are adjusted to each other. For driving the rollers of the inking unit use is made of a gear wheel 15 supported by the frame 13, which is engaging a gear wheel 16 connected to the support 17 of the inking unit when the inking unit 11 is pivoted to its active position. As seen in FIGS. 1 and 2 the hinge pin 12 is positioned at the back of the support 17 and the gear wheels 15 and 16 are positioned directly behind the front plate 18 of the support 17. On the outer side of this front plate 18 the closing device 19 is provided which in the encircled portion of FIG. 2 is shown in view and will be further discussed by means of the FIGS. 10 and 11.

The inking unit 11 being schematically shown in FIG. 2 comprises the ink duct 20 cooperating with the ink-duct roller 21 from which the ink by means of the ductor roller 22, which is pivoting to and fro, can be supplied to the succeeding rollers 23, 24, 25 and 26. In this case two rollers 26 can be present from which the ink is supplied to the printing plate 10.

Figure 4:
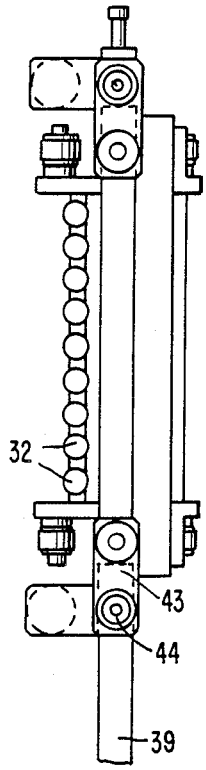
FIG. 4 shows an end view of the ink duct of FIG. 3.
Figure 5:
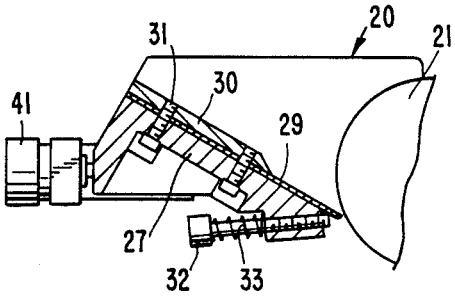
FIG. 5 and 6 show cross sections at an enlarged scale, according to the line V—V and VI—VI respectively of FIG. 3.
Figure 6:
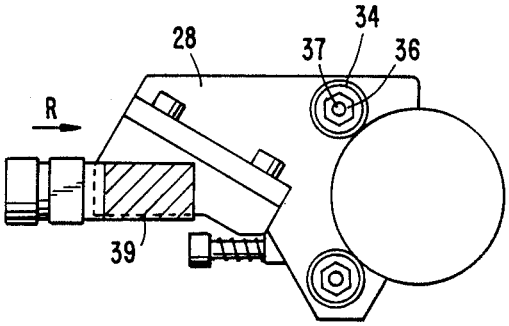

The FIGS. 4–6 show the particular construction of the ink duct 20. The ink duct comprises a bottom 27 and two side walls 28 which are connected with it in a not further described way. The bottom extends in a thin plate 29 from which the upper part is connected to the bottom 27 by means of a pressing plate 30 and screws 31. The lower edge of the thin plate 29 is pressed towards the ink-duct roller 21 by means of a number set screws 32 provided over the length of the plate and being locked against rotation by means of springs 33. In this way the lower edge of the thin plate 29 can be brought exactly at the desired distance of the ink-duct roller 21 over its total length. To maintain the side walls 28 also exactly at the desired distance from the ink-duct roller 21 without causing too much friction, each side wall 28 is provided with two rolls 34. Each roll 34 is supported by an excentric portion 35 forming part of a nut 36 being screwed onto a pin 37 which is fixedly connected to the side wall 28.

The bottom 27 of the ink duct 20 is slidably supported by means of a strip 39 which in a way not shown is fixed to the support 17.

Figure 3:
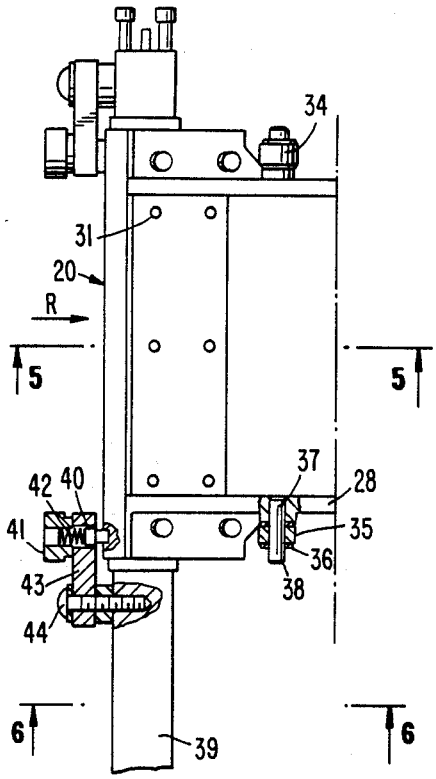
FIG. 3 shows a plan view of an ink duct used in case of the inking unit shown in FIG. 2 with some parts in cross section.

As indicated by the arrow R in the FIGS. 3 and 6 the ink duct 20 is biased towards the ink-duct roller 21 by means of two pins 40. Each pin 40 is provided in a knob 41 in which a spring 42 is received to bias the pin against the ink duct 20. The knob 41 is provided in a pivoting arm 43, the other end of which is pivotably connected to the strip 39 by means of a screw 44. In this way the knob 41 and by this the pin 40 can easily be pivoted away to release the ink duct 20.

Figure 7:
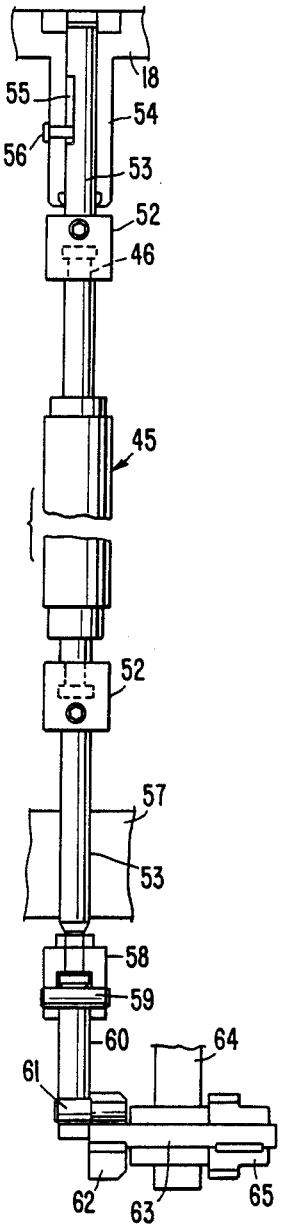
FIG. 7 shows a plan view of a distributor roller with its support and the drive for it.
Figure 8:
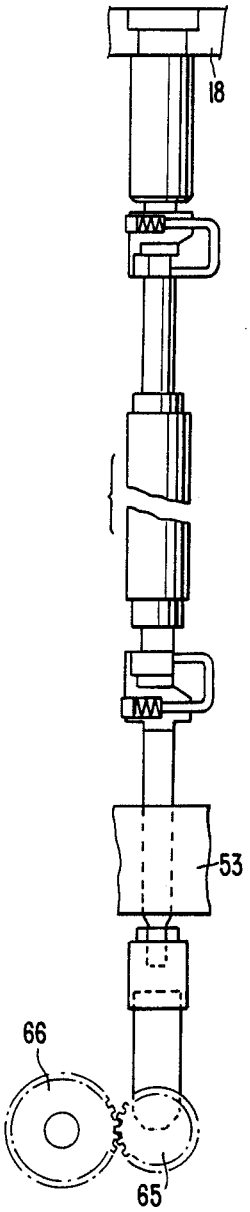
FIG. 8 shows a side view of the parts shown in FIG. 7.
Figure 9:
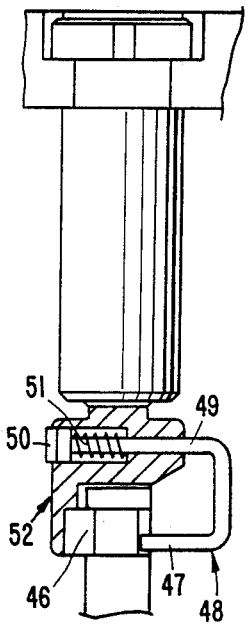
FIG. 9 shows a detail of FIG. 8 at an enlarged scale.

The FIGS. 7–9 show the support and drive of a distributor roller 45, see also FIG. 2. The rollers 23 and 25 shown in this figure also are distributor rollers.

The ends of the roller 45 are provided with some portions with smaller diameter such that grooves 46 are obtained, see in particular FIG. 9. The one leg 47 of an U-shaped bow 48 can be received in the groove 46, the other leg 49 of said bow being provided with a thickened portion 50 against which one end of a compression spring 51 is lying. By this the leg 47 will be resiliently pressed into the groove 46. The leg 49 of the bow 48 is received in a bore in a support 52 which is engaged by the spring 51. As in particular appears from FIG. 7 the support 52 comprises a pin 53 being shiftably received in a sleeve 54 which is mounted or is forming part of the front plate 18 of the support 17. By means of a slot 55 provided in the pin 53 and by means of a screw 56 provided in the sleeve 54 the stroke of the support 52 can be limited. In the same way as shown in FIG. 9 the other end of the roller 45 is supported and the pin 53 of the support 52 now is guided by a wall portion 57 forming part of the support 17. The pin 53 now is provided with a fork 58 in which by means of a pin 59 a connecting rod 60 is pivotably comprised. The other end of the connecting rod is rotatably mounted to a pin 61 which by means of a crank web 62 is excentrically mounted to a shaft 63 being rotatably supported by means of a wall 64 of the support 17. The shaft 63 is driven by means of a gear wheel 65 connected to it. The gear wheel 65 in its turn is engaging a gear wheel 66 which in a way not further shown is driven from the gear wheel 16.

Figure 11:
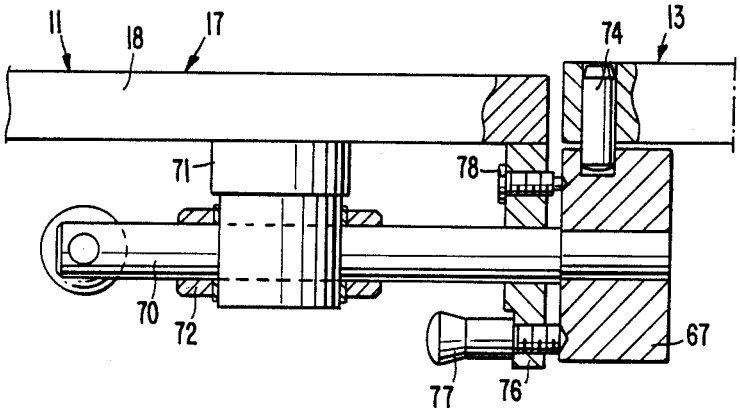
FIG. 11 shows a cross section according to the line XI—XI of FIG. 10.
Figure 10:
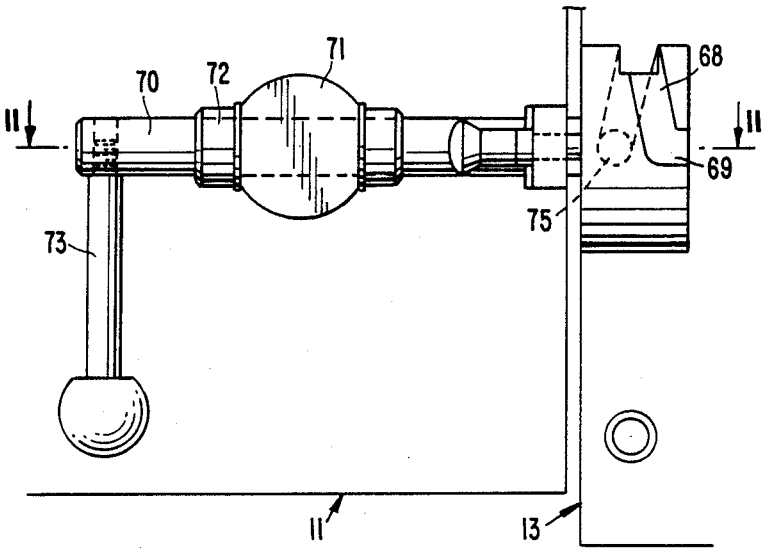
FIG. 10 shows a side view of the parts for coupling an inking unit to the frame of the device.

The FIGS. 10 and 11 show more in detail the fastening device 19 as this is shown in side view in FIG. 2.

The fastening device in particular comprises a curve roll 67 in which the curve 68 is provided which at its one end 69 runs into a radial surface of the curve roll 67. The curve roll 67 is fixedly mounted to a shaft 70 which is rotatably supported by a wall portion 71 extending from the front wall 18 of the support 17. The shaft 70 is fixed in axial direction in respect of the wall portion 71 by means of rims 72 mounted on the shaft. Rotating of the shaft takes place by means of a handle 73. The curve roll 67 connected to the inking unit 11 cooperates with a pin 74 connected to the frame 13 of the device. In the FIGS. 10 and 11 the position is shown in which the inking unit 11 is present in the active position. In case of this the pin 74 is received in the closed end 75 of the curve 69. When now the curve roll 67 is rotated by means of the handle 73 the curve 68 is moving towards a position in which the pin 74 is present near the open end 69. In FIG. 10 this place of the pin is indicated by 75'. By moving the curve roll 67 in respect of the pin 74 the gear wheels 15 and 16 are brought out of engagement, see FIG. 1, so that the related inking unit is switched off. To be able to pivot the inking unit 11 totally away, the handle 73 is further rotated so that the pin 74 can leave the curve 68 through the open end 69 of it.

For holding the curve roll 67 in said positions pins 77 and 78 can be screwed into a wall portion 76 extending from the wall 18 in which, in a not further described way, resiliently supported balls can be received which can come to lie in recessesses provided in the curve roll 67.

As schematically shown in FIG. 2 given rollers can be supported by means of bearings 79 which in a not further indicated way are shiftably supported in radial direction and are biased by means of springs 80.

It will be obvious that only a possible embodiment of the device according to the invention is shown in the drawing and described above and that many modifications can be made without departing from the spirit of the invention.

What is claimed:

1. Device for printing objects (8) such as cups from synthetic material, said device comprising a frame (15), a rotating assembly (3) with a plurality of mandrels (4) on it, on which the cups are shifted which are to be printed and which are supplied by a supply apparatus (2) so that they can subsequently be contacted by a printing roller (7), said printing roller (7) cooperating with a plurality of printing plates (10) each being mounted on a printed cylinder (9), to which printing plates ink with various colours can be supplied by means of a plurality of inking units (11), each being mounted in its own pivotable support (17) and comprising an ink-duct roller (21), with an ink duct (2) engaging it, an ink knife (29), a ductor roller (22), idler rollers (23–25), forme roller (26) and distributor rollers (45) comprising means for slidably supporting the ink duct (20), means for biasing the ink duct towards the ink-duct roller (21), said ink duct (20) comprising a bottom (27) extending obliquely downwards to the ink-duct roller (21) and side walls (28) joining this bottom, two roll (34) mounted on the outer side of each of said side walls by means of pins (37) and engaging the ink-duct roller (21) and each being rotatably supported by a surface (35) which is eccentric in respect of the axis of said pin (37) on which it is mounted, said eccentric surface being adjustable and fixable in respect of said wall (28).

2. A device according to claim 1, wherein the portion of the bottom (27) of the ink-duct (20) joining the ink-duct roller (21) is in the shape of a thin plate (29) the edge of which is adjustable with respect to the ink-duct roller (21) by means of a plurality of set screws (32) distributed along the length of the plate (29).

3. Device according to claim 1, wherein the biasing of the ink-duct (20) takes place by means of pins (40) spring (42) biased against the ink-duct (20), each pin being movably received in one end of an arm (43) the other end of which is pivotally connected to the ink-duct support (39) so that the pivoting axis of the arm (43) extends parallel to the axis of the pin (40).

4. Device according to claim 1, wherein said rollers are driven and each distributor roller (45) is axially movably by means of a crank mechanism (58–63) coupled with the drive of the other driven rollers (9,21,26).

5. Device according to claim 4, wherein the distributor roller (45) at both ends is provided with a radially directed recess (46) in which a spring biased pin (47–49) is received for biasing the distributor roller (45) towards the roller (26) cooperating with said distributor roller.

6. Device according to claim 1, the various rollers (21–26,45) are supported by spring (80) biased bearings (79).

7. Device according to claim 1, wherein a gear wheel (16) is mounted to the pivotably inking unit support (17) and said pivotably inking unit support (17) is executed such that when moving the inking unit (11) towards the active position said gear wheel (16) mounted to it engages a gear wheel (15) which is driven from a common motor and is supported by said frame (13) of the device, in which position the inking unit (11) can be fastened by means of a roll (67) rotatably around a shaft (70) running perpendicular to the hinge pin and being provided with a curve (68) being open at one end (69) lying in a radial plane for receiving a pin (74) connected to the frame (13) of the device.

8. Device according to claim 7, wherein the roll (67) can be locked in two positions by an element which resiliently snaps into a cavity of the roll (67).

9. Device according to claim 1, wherein the object supply means (2) and the discharge means (2') with their supports are slidable over a given distance in a direction mainly transverse to the center line of the printing roller (7).

* * * * *